US008646784B2

(12) United States Patent
Boilard et al.

(10) Patent No.: US 8,646,784 B2
(45) Date of Patent: Feb. 11, 2014

(54) ICE SKATE BLADES AND METHOD FOR IMPROVING PERFORMANCES THEREOF

(75) Inventors: Patrick Boilard, Terrebonne (CA); Benoit Beausejour, St-Charles-Borromee (CA); Luc Mainville, Joliette (CA)

(73) Assignee: Technique Surface Lab Inc., Terrebonne (CA)

( * ) Notice: Subject to any disclaimer, the term of this patent is extended or adjusted under 35 U.S.C. 154(b) by 0 days.

(21) Appl. No.: 13/822,115

(22) PCT Filed: Sep. 30, 2011

(86) PCT No.: PCT/CA2011/050613

§ 371 (c)(1), (2), (4) Date: Mar. 11, 2013

(87) PCT Pub. No.: WO2012/040856

PCT Pub. Date: Apr. 5, 2012

(65) Prior Publication Data

US 2013/0175772 A1 Jul. 11, 2013

Related U.S. Application Data

(60) Provisional application No. 61/388,060, filed on Sep. 30, 2010.

(51) Int. Cl.
*A63C 1/30* (2006.01)

(52) U.S. Cl.
USPC ..... 280/11.18

(58) Field of Classification Search
USPC ..... 280/11.12, 11.18, 811; 427/367
See application file for complete search history.

(56) References Cited

U.S. PATENT DOCUMENTS 2,108,128 A * 2/1938 Kinney ..... 280/11.18
4,314,708 A * 2/1982 Zuuring ..... 280/11.18

(Continued)

FOREIGN PATENT DOCUMENTS

| | | |
|---|---|---|
| CA | 2455891 | 1/2006 |
| CA | 2477022 | 2/2008 |
| CH | 684575 | 10/1994 |

OTHER PUBLICATIONS

Horkheimer, Donald—Improvements in Ice-Skate Blade Performance Through the Use of PVD and CVD Plasma Hard Coatings, Jun. 6, 2007, Student ID: 2132334, ME 5361 Plasma-Aided Manufacturing, Instructor: Dr. Joachim V. R. Heberlein.

(Continued)

*Primary Examiner* — J. Allen Shriver, II
*Assistant Examiner* — James Triggs
(74) *Attorney, Agent, or Firm* — Goudreau Gage Dubuc; Gwendoline Bruneau

(57) ABSTRACT

A method and a system for improving performances of an ice skate blade on ice, comprising selecting a substrate for the blade and controlling wettability of the surface of the substrate, by selecting a surface finish for the surface of the substrate and depositing a thin film coating on the surface of the substrate. The method allows autolubrication of the ice skate blade. The autolubricating ice skating blade comprises a substrate and a thin film coating deposited on the substrate, the substrate having a first friction coefficient on ice, and the blade having a second friction coefficient on ice, the second friction coefficient being decreased compared to the first friction coefficient.

14 Claims, 5 Drawing Sheets

(56) References Cited

U.S. PATENT DOCUMENTS

| | | | | |
|---|---|---|---|---|
| 5,255,929 | A * | 10/1993 | Lemelson | 280/11.18 |
| 5,360,227 | A | 11/1994 | Lemelson | |
| 5,516,556 | A * | 5/1996 | Baker et al. | 427/355 |
| 6,523,835 | B1 * | 2/2003 | Lyden | 280/11.12 |
| 6,620,523 | B2 * | 9/2003 | Abkowitz et al. | 428/627 |
| 6,712,915 | B2 * | 3/2004 | Symko et al. | 148/415 |
| 6,761,363 | B2 * | 7/2004 | Fask et al. | 280/11.18 |
| 7,556,700 | B2 | 7/2009 | Boisvert | |
| 7,648,146 | B2 * | 1/2010 | Tatomir | 280/11.18 |
| 7,673,884 | B2 * | 3/2010 | Wuerthner | 280/11.18 |
| 7,771,289 | B2 * | 8/2010 | Palumbo et al. | 473/324 |
| 7,866,675 | B2 * | 1/2011 | Hauser | 280/11.18 |
| 8,033,551 | B2 * | 10/2011 | Tatomir | 280/11.18 |
| 8,387,286 | B2 * | 3/2013 | Koyess et al. | 36/115 |
| 2005/0082773 | A1 | 4/2005 | Julien | |
| 2007/0262540 | A1 | 11/2007 | Juell | |
| 2010/0176564 | A1 * | 7/2010 | Koyess et al. | 280/11.12 |
| 2010/0201088 | A1 * | 8/2010 | Newman et al. | 280/11.18 |

OTHER PUBLICATIONS

International Search Report from co-pending PCT Application No. PCT/CA2011/050613.

* cited by examiner

ICE SKATE BLADES AND METHOD FOR IMPROVING PERFORMANCES THEREOF

FIELD OF THE INVENTION

The present invention relates to ice skate blades. More precisely, the present invention relates to ice skate blades and a method for improving performances thereof.

BACKGROUND OF THE INVENTION

There are a different types of ice skates: the figure skate, the hockey skate, the bandy skate, the racing skate and the touring skate.

Ice skating is based on the metal blade at the bottom of the skate shoe gliding with very little friction over the surface of the ice. Skaters can increase friction and control their movement at will, by slightly leaning the blade over and digging one of its edges into the ice for example. Skaters can also use gravity to control and increase their momentum, by moving along curved paths while leaning their bodies radially and flexing their knees, for example. They can also create momentum by pushing the blade against the curved track which it cuts into the ice.

The phenomena have been studied in some depth. Experiments have shown that ice has a minimum kinetic friction at −7 C, and many indoor skating rinks set their system to a similar temperature. [The low amount of friction actually observed has been difficult for physicists to explain, especially at lower temperatures. On the surface of any body of ice at a temperature above about −20° C., there is always a thin film of liquid water, ranging in thickness from only a few molecules to thousands of molecules. The thickness of this liquid layer depends almost entirely on the temperature of the surface of the ice, with higher temperatures giving a thicker layer.

Traditionally, this layer of water on the ice has been controlled either by controlling the temperature of the ice, i.e. by heating, or by controlling the contact geometry of the blade, i.e. by controlling the pressure exerted on the ice.

There is still a need in the art for ice skate blades and method for improving performances thereof.

SUMMARY OF THE INVENTION

More specifically, there is provided a method for improving performances of an ice skate blade on ice, comprising selecting a substrate for the blade; and controlling wettability of the surface of the substrate, by selecting a surface finish for the surface of the substrate and depositing a thin film coating on the surface of the substrate.

There is provided a method for autolubrication of an ice skate blade, comprising selecting a substrate for the blade and controlling wettability of the surface of the substrate, by selecting a surface finish for the surface of the substrate and depositing on the surface at least one thin film coating.

There is provided an autolubricating ice skating blade, comprising a substrate and a thin film coating deposited on the substrate, the substrate having a first friction coefficient on ice, the blade having a second friction coefficient on ice, the second friction coefficient being decreased compared to the first friction coefficient.

There is provided a method of manufacturing a ice skate blade, comprising selecting a substrate and controlling wettability of the surface of the substrate, by selecting a surface finish for the surface of the substrate and depositing a thin film coating on the surface.

Other objects, advantages and features of the present invention will become more apparent upon reading of the following non-restrictive description of embodiments thereof, given by way of example only with reference to the accompanying drawings.

DESCRIPTION OF EMBODIMENTS OF THE INVENTION

In a nutshell, there is provided a method and a system for improving performances of ice skate blades on ice, allowing controlling the wettability of the surface of the blade, by selecting a combination of a substrate, a surface finish for the surface of the substrate and at least one thin film coating deposited on the surface of the substrate.

The present method and system allow increasing lubrication of an ice skate blade by controlling the wettability of the surface of the blade, and therefore the capability of the blade surface to attract water.

In an embodiment of an aspect of the present invention, a thin film coating of a thickness comprised in a range between a few nanometers and a few micrometers is deposited on the surface of the substrate of skate blades.

The substrate is typically one used for blades, such as for example, steel, stainless steel, tool steel, powder metallurgy alloys, and tungsten carbide etc. The substrate to be considered depends on the type of the blade. In the case of hockey skate blades, the substrate is generally a stainless steel (type 420 or 440), while in the case of speed skating blades, the substrate may be stainless steel (420 or 440), a powder metal alloy or another steel (tool steel for example).

The thin film may be deposited using physical vapor deposition (PVD) or plasma assisted chemical vapor deposition (PACVD) for example.

The thin film coating comprises a carbon-based top layer. A number of underlayers may be provided, between the substrate and the carbon-based top layer. The underlayers may be in metals, such as Cr, Ti, TiAl, Ni and W for example; nitrides, such as CrN, TiN and TiAlN for example; oxides; carbides; or they can be siliceous or carbon based layers for example (a-C:H (DLC), ta-C, WCC, . . . ). Other materials having a low friction coefficient may be contemplated, such as solid film lubricants or polymers such as PTFE for example.

Prior to deposition of the thin film coating, the substrate, i.e. the surface to be coated, may be treated, for example submitted to nitriding, carburation or thermoreactive diffusion (TR or TRD).

The substrate may be polished or not prior to deposition of the thin film coating. It was found that the performance of the coated blade may be enhanced with a modification of the microtexture of the surface of the substrate.

Figure 3B:
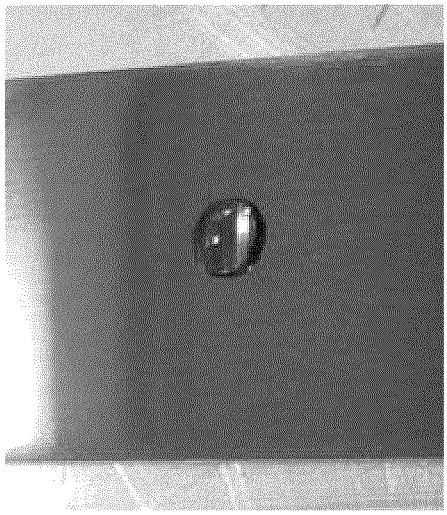
FIG. 3 illustrate the effect of texturation on wettability of a stainless steel substrate : a) a sandblast finish; b) standard surface finish, i.e. surface with a texture generally oriented along the gliding direction of the blade; and (c) polished surface.
Figure 3A:
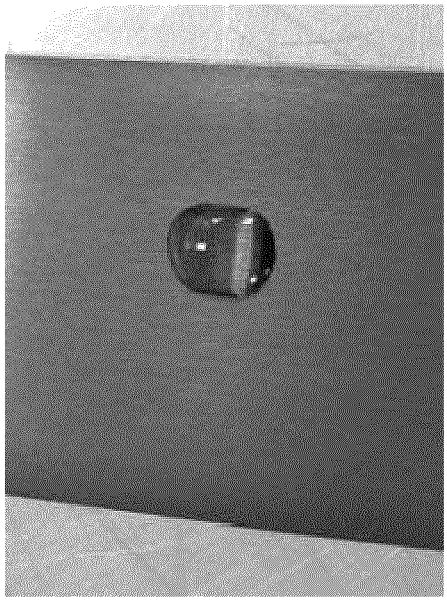

FIG. 3*a* shows wettability of a stainless steel substrate having a sandblast finish : the roughness is the same in every measurement direction, with an average amplitude of height of the texture on the surface in a range between about 1 and 1.3 micrometers. FIG. 3*b* shows wettability of a stainless steel substrate having a standard surface finish, i. e. provided with thin lines in the gliding direction of the blade : the roughness, i.e. the average amplitude of height of the texture on the surface, in the direction perpendicular to the gliding direction of the blade, is in a range between about 0.6 and 0.8 micrometers. FIG. 3*c* shows wettability of a stainless steel substrate having a polished surface finish : the roughness, i.e. the average amplitude of height of the texture on the surface, in the direction perpendicular to the gliding direction of the blade, is below 0.1 micrometer.

Figure 4A:
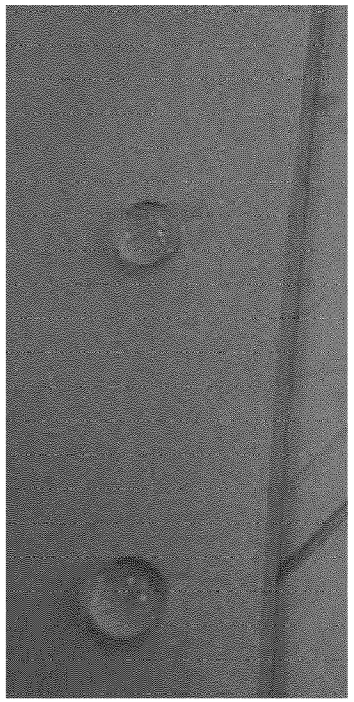
FIG. 4 illustrate the effect of texturation on wettability of a surface : a) standard surface finish, i.e. surface with a texture generally oriented along the gliding direction of the blade; (b) polished surface.
Figure 4B:
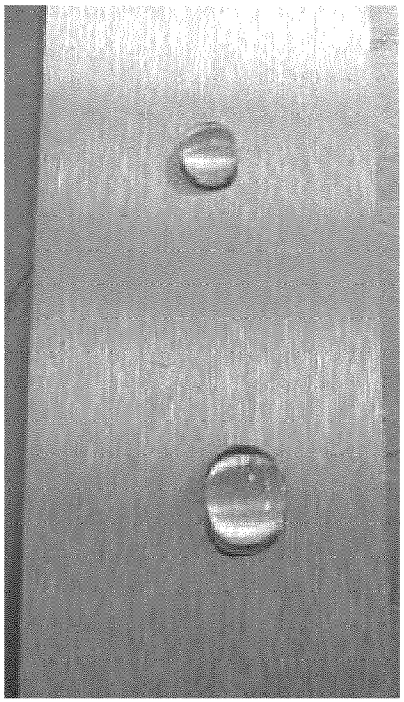
Figure 4C:
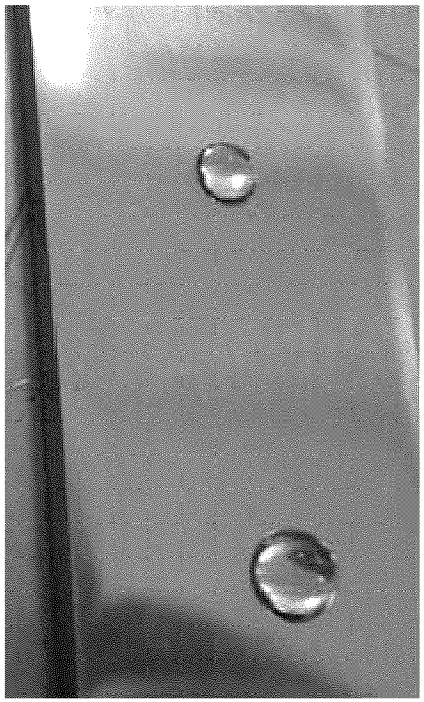

FIG. 4*a* shows increased an wettability of the thin film coating on a surface provided with a texture (thin scratches or lines) generally oriented along the gliding direction of the blade, compared to when the surface is polished (FIG. 4*b*): the drop in FIG. 4*a* spreads along the direction of the texture.

Figure 5B:
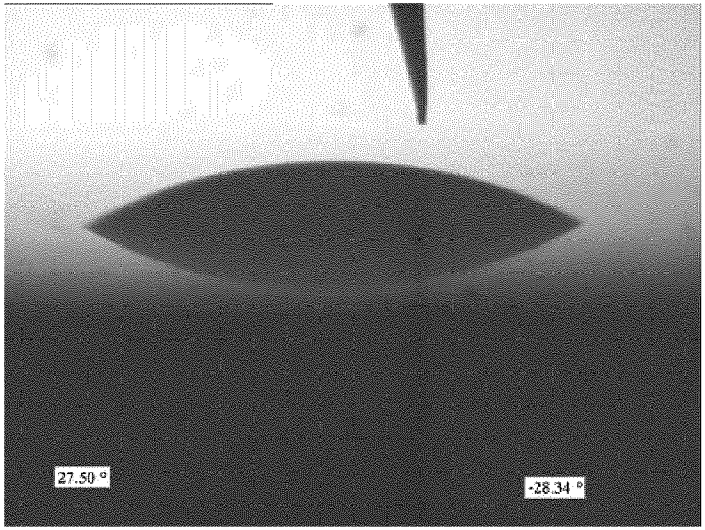
FIG. 5 illustrate the effect of substrate surface on wettability.
Figure 5A:
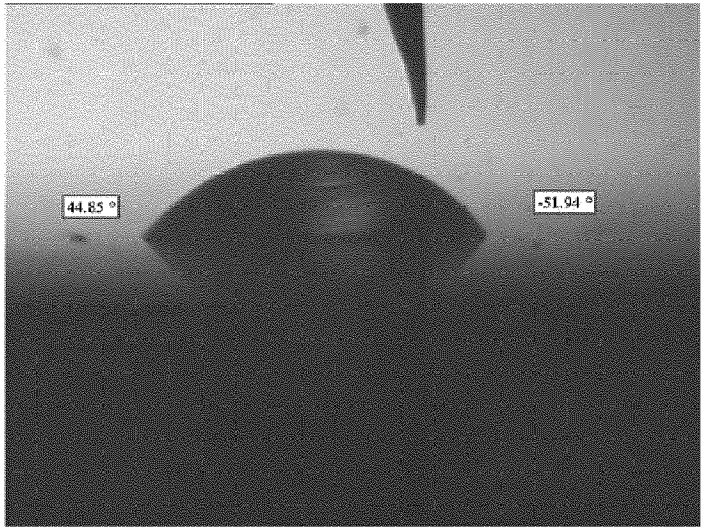

Wettability is increased from a stainless steel substrate having a standard surface finish, i. e. provided with thin lines in the gliding direction of the blade to the same substrate covered with a DLC coating. FIG. 5 show water drops on a stainless steel surface (a) and on a DLC surface (b). The water drop on stainless steel with a standard surface finish has an average angle of 55.1°, compared to an angle of 31.6° on a DLC surface with a standard surface finish.

A blade surface with an increased wettability has an increased capacity to attract water, thereby generating its own lubrication.

Also, deposition may be performed before or after sharpening the surface of the blade to be coated.

Moreover the surface to be coated may bear a logo or other identifying marks thereon, since such indication will remain visible once the surface is coated with the present thin film coating, which is essentially transparent.

Then, the substrate is first cleaned and put in a vacuum chamber at a pressure less than atmospheric pressure, typically under a pressure less than $5\times10^{-2}$ mbar. The blades may then be heated to rid the surface of residual adsorbed water molecules, typically a temperature between 150 and 350° C. A temperature range from 25 to 500° C. could be used. It would also be possible to prepare the surface via another process so that no heating would be necessary. The blades are then cleaned/etched with an ionized gas, such as argon for example.

The present thin film coating is found to increase the properties of the blades, such as skating blades, hockey blades, bandy skates, racing skates, touring skates, skis, bobsleigh, sleigh etc. . . . for example, on ice.

As mentioned hereinabove, a number of underlayers may be provided, between the substrate and the carbon-based top layer.

A first thin film underlayer, such as a layer of chromium (Cr) selected for its good adhesion to the steel substrate, may for example be deposited by PVD on the substrate. Its thickness can range from a few nm to a few microns, for example below 200 nm, for example below 100 nm.

A second underlayer may then be deposited by PVD on top of the first underlayer. The second underlayer may be a chromium nitride (CrN) layer for example, CrN being harder than the chromium of the first underlayer layer and able to contribute to the load bearing capability of the overall coating. Its thickness can range from a few nm to a few microns, for example from 1 nm to 50 μm, for example from 0.5 μm to 3 μm.

A third underlayer, such as a-$SiC_x$:H, may then be deposited by PACVD. This underlayer may be selected to improve the adhesion of the top layer on the substrate or on the underlayers. Its thickness can range from a few nm to a few microns, from 1 nm to 5 μm for example, for example from 0.1 μm to 1 μm.

The top carbon-based layer, such as a diamond-like carbon (DLC) (a-C:H) or a tungsten carbon carbide (WCC) layer, is then deposited by PACVD on top of the last underlayer. Its thickness can range from a few nm to a few microns, for example from 1 nm to 10 μm. A typical thickness could be 3 μm.

The top layer is selected to have a superior hardness and a lower friction coefficient than the substrate to be coated. The underlayers, i.e. between the substrate and the top layer, are bonding layers, which may increase the adhesion of the top layer on the substrate, i.e. on the material of the blade.

The following coatings could be contemplated for example:

SS420+Cr (0.1 μm)+CrN (2 μm)+SiCH (0.5 μm)+DLC (3 μm).

SS420+TiN (2 μm)+SiCH (0.5 μm)+DLC (3 μm).

SS420+Cr (8 μm)+SiCH (0.5 μm)+DLC (5 μm).

SS420+Cr (0.2 μm)+CrN (0.2 μm) +Cr (0.2 μm)+CrN (0.2 μm)+Cr (0.2 μm)+CrN (0.2 μm) + . . . +SiCH (0.5 μm)+DLC (3 μm).

SS420+plasma nitriding+TiN (3 μm)+SiCH (0.5 μm)+DLC (3 μm).

SS420+liquid nitriding+Cr (0.1 μm)+CrN (1 μm)+WCC (1 μm)+DLC (3 μm).

After the deposition process described hereinabove, the sequence of thin film layers on the blade can thus be, for example, as follows: hockey skate blade (SS420)/Cr (0.1 μm)/CrN (2 μm)/SiCH (0.5 μm)/DLC (3 μm).

The blades may then be sharpened if they have not been sharpened prior to the deposition, the deposited thin layer coating remaining at least on the edges and sides of the blades.

Figure 1:
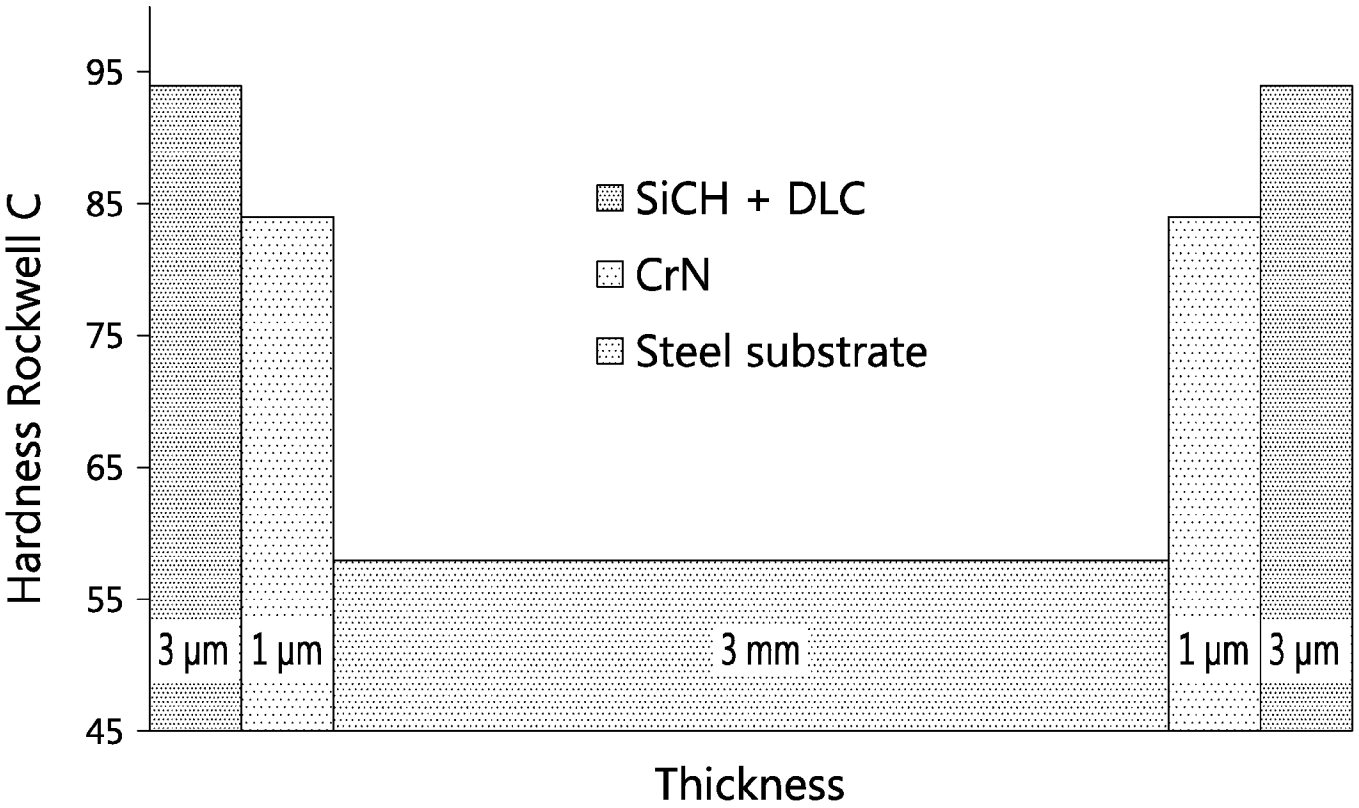
FIG. 1 shows an example of a hardness profile achieved with a coating according to an embodiment of an aspect of the present invention.

FIG. 1 shows an example of a hardness profile of blades according to an aspect of an embodiment of the present invention.

Comparative tests under controlled environment have been performed to assess the performances of blades according to the present invention, by measuring the friction coefficients of different samples produced using the method of the present invention, on ice. These tests also allowed assessing the effects of the surface finish of the coating on the performances on ice.

In these tests, steel disks of a weight of 2.47 kg were accelerated on an iced surface moving an angular speed of 1500 RPM. The disks having a diameter of 12.5 cm, these conditions are approximately equivalent to a skater having a linear speed of 5 m/s. In case of a friction coefficient of 1, the disks are expected to be rotating on the surface with the same angular speed as the surface. As the friction coefficient tends to 0, the disks take more and more time reaching the angular speed of the iced surface.

Newton's second law (F=ma) was used as a basis for deriving friction coefficients from the measurements. The energy Ef dissipated by friction and the kinetic energy Ec are defined as follows :

$$Ec=\tfrac{1}{2}Jm*\omega^2 \text{ with } Jm=\tfrac{1}{2}m\,(Re^2+Ri^2)$$

$Ef=(F)$ friction$*d$ with $(F)$ friction$=Cf*N=Cf*m*g$ and $g=9{,}8$ m/s$^2$ $$Ef=Cf*m*g*d$$

The distance d covered by the disk on the ice is assessed as:

$$D=2\,\pi Req.\theta rer,$$

with:

$$Req.=2/3(Re^3-Ri^3)/(Re^2-Ri^2)$$

$$\theta rer.=\omega^2/2*\propto$$

$$\propto\ =\frac{\omega}{\Delta t}$$

Since the energy Ef dissipated by friction is equal to the kinetic energy Ec, with Ec=½ Jm*$\omega^2$=Ef=Cf*m*g, the coefficient of friction is obtained as follows:

$$Cf\ =1/2^{*}\,Jm^{*}(\omega^{2^{m\times\frac{\omega^2}{\cdot\cdot}}}\ /(\mathrm{m}^{*}\mathrm{g}).$$

The following tables summarize the different measurements taken and computations performed.

| Data | Unit | Conversion Unit |
|---|---|---|
| m (weight f disk) | 2.47 kg | |
| ω (angular rotation speed) | 1500 RPM | 157.1 Rad/s |
| Re (external radius of disk) | 2.5 po | 0.0635 meter |
| Ri (internal radius of disk) | 0.25 po | 0.00635 meter |

TABLE I

| Calculus | Unit | Conversion Unit |
|---|---|---|
| Req. (equivalent friction radius) | 1.682 po | 0.0427 meter |
| N (normal force) | 24.2 Newton | |
| Jm (weight rotational inertia) | 0.0050 Kg * m$^2$ | |
| Ec (kinetic energy) | 62.1 Joule | |

TABLE II

| | | Temperature = −7° C. | | | |
|---|---|---|---|---|---|
| | Unit | rough uncoated 8.57 | rough DLC 15.19 | polished uncoated 12.44 | polished DLC 16.16 |
| α (angular acceleration) | rad/s$^2$ | 18.33 | 10.34 | 12.63 | 9.72 |
| θ (# revolution) | rad | 673 | 1193 | 977 | 1269 |
| d (covered distance) | m | 180.7 | 320.2 | 262.2 | 340.7 |
| friction coefficient | | 0.014 | 0.008 | 0.010 | 0.008 |

TABLE III

| | | Temperature = −15° C. | | | |
|---|---|---|---|---|---|
| | Unit | rough uncoated 8.9 | rough DLC 13.77 | polished uncoated 11.8 | polished DLC 18.25 |
| α (angular acceleration) | rad/s$^2$ | 17.65 | 11.41 | 13.31 | 8.61 |
| θ (# revolution) | rad | 699 | 1081 | 927 | 1433 |
| d (covered distance) | m | 187.6 | 290.3 | 248.8 | 384.7 |
| friction coefficient | | 0.014 | 0.009 | 0.010 | 0.007 |

Figure 2A:
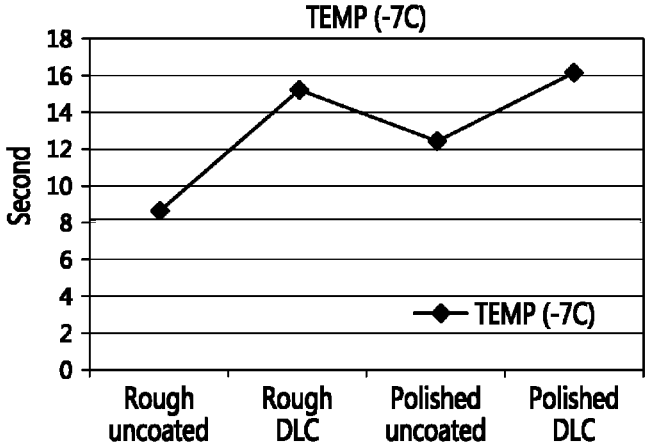
FIG. 2 show comparative tests.
Figure 2B:
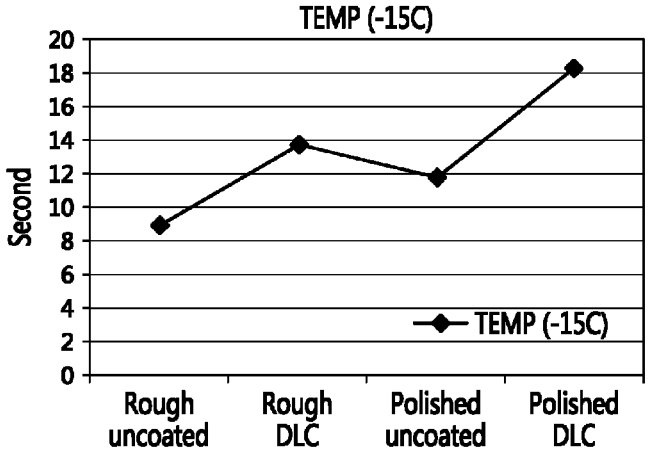

FIG. 2 show results of such comparative tests on rough, i.e. non polished, DLC coatings according to the present invention (referred to as rough DLC), uncoated steel surfaces (referred to as rough uncoated), polished steel uncoated surfaces (referred to as polished uncoated) and polished DLC coatings according to the present invention (referred to as polished DLC). Each disk was deposited flat on an iced surface before the iced surface was allowed to quickly accelerate until a maximum speed of 1500 RPM, the disks being thus accelerated in turn until reaching the maximum speed of the iced surface. For each disk, the average acceleration time in second was measured, at a temperature of −7° C. and at a temperature of −15° C.

It appeared that the coefficient of friction is decreased by using a DLC coating, compared to using a polished uncoated surface and even more so when compared to using an unpolished uncoated surface, at a temperature of −7° C.

At a temperature of −15° C., using a polished DLC coating decreased the coefficient of friction compared to using an unpolished DLC coating, using an unpolished DLC coating allowed decreasing the coefficient of friction compared to using an unpolished uncoated surface, and using an unpolished uncoated surface allowed decreasing the coefficient of friction compared to using a polished uncoated surface.

It thus appears that the friction coefficient decreases when using a DLC coating. A polished DLC coating is found to increase performances on ice at −15° C. by about 35% compared to a polished uncoated surface. An unpolished DLC surface is found to increase performances on ice at −7° C. by about 44% compared to a rough uncoated surface, and by about 18% compared to a polished uncoated surface.

The present combinations of coatings and polished substrates are found to yield lower friction coefficients.

A good affinity of water to the coatings is found to optimize the performances of the skates on ice.

The temperature of the ice is believed to be of importance. An ice temperature in a range between about −6 and −9° C. is considered as optimizing the skating performances, as colder temperatures may prevent the formation of a lubrication film between the blade and the ice. The present combinations of coatings and substrates are found to help the formation of a lubrication film between the blade and the ice. Using a DLC coating may help the formation of a lubrication film between the blade and the ice at lower temperatures.

The present combinations of coatings and substrates are found to increase the performances of the blades, in terms of sliding capacity and directional control for example, as well as their durability, in terms of resistance to wear out.

In terms of sliding performance, the present blades proves to have a lowered friction coefficient, which enhances the speed of the skater, helps maintain the speed of the skater or helps attain longer gliding distances with a given impulsion.

Depending on the ice and the skaters characteristics, the increase in gliding distance may reach up to 50%.

The present coating provides a high performance surface with increased hardness. The present blades offer more bite and more glide, and provide the user with more power to achieve a desired performance.

In terms of resistance to wear, the present coating lowers the wear rate of the blade or of its sharpened edges. This allows for the blade to be used longer before it requires sharpening. Tests on hockey blades provided with the present coating showed up to a 4× increase in durability before resharpening of the blade. In one test, the edges were still satisfactory to the user after 15 hours of use. In another test, the coated blades lasted 45 hours compared to 10-12 hours between sharpening for uncoated blades. The increase in durability may range from 1× to 100×.

Although the present invention has been described hereinabove by way of embodiments thereof, it may be modified, without departing from the nature and teachings of the subject invention as defined in the appended claims.

What is claimed is:

1. Autolubricating ice skating blade, comprising a substrate and a thin film coating deposited on the substrate, said substrate having a first friction coefficient on ice, said blade having a second friction coefficient on ice, the second friction coefficient being decreased compared to the first friction coefficient.

2. The blade of claim 1, wherein the substrate is one of: steel, stainless steel, tool steel, powder metallurgy alloys and tungsten carbide.

3. The blade of claim 1, wherein said substrate is treated prior to deposition of said thin film coating.

4. The blade of claim 1, wherein said substrate is polished prior to deposition of said thin film coating.

5. The blade of claim 1, wherein said substrate has a surface finish.

6. The blade of claim 1, wherein said thin film coating has a thickness comprised in a range between 1 nm and 10 μm.

7. The blade of claim 1, wherein said thin film coating has a thickness of about 3 μm.

8. The blade of claim 1, wherein said thin film coating comprises at least one underlayer and a top layer.

9. The blade of claim 1, wherein said thin film coating comprises at least one underlayer and a top layer, said underlayer being in one of : metals, nitrides, oxides; carbides, siliceous based layers, carbon based layers, solid film lubricants and polymers.

10. The blade of claim 1, wherein said thin film coating comprises at least one underlayer and a top layer, said underlayer being in one of : Cr, Ti, TiAl, Ni, W, CrN, TiN, TiAlN, a-C : H (DLC) layers, ta-C layers, and WCC layers.

11. The blade of claim 1, wherein said thin film coating comprises a first layer in chromium, a second layer in chromium nitride, a third layer in a-$SiC_x$:H, and a top carbon-based layer.

12. The blade of claim 1, wherein said thin film coating comprises a first layer in chromium, a second layer in chromium nitride, a third layer in a-$SiC_x$:H, and a top carbon-based layer, and said top carbon-based layer is one of a diamond-like carbon (DLC) (a-C:H) and a tungsten carbon carbide (WCC) layer.

13. The blade of claim 1, wherein said thin film coating comprises a first layer in chromium, a second layer in chromium nitride, a third layer in a-$SiC_x$:H, and a top carbon-based layer, and said first layer has a thickness of at most 200 nm, said second layer has a thickness in a range between 1 nm and 50 μm, said third layer has a thickness in a range between 1 nm and 5 μm, and said top carbon-based layer has a thickness in a range between 1 nm and 10 μm.

14. A method of manufacturing an ice skate blade, comprising:

selecting a substrate; and controlling the wettability of the surface of the substrate, by selecting a surface finish for the surface of the substrate and depositing a thin film coating on the surface;

wherein said selecting a substrate comprises selecting the substrate among steel, stainless steel, tool steel, powder metallurgy alloys and tungsten carbide and said depositing a thin film coating on the surface of the substrate comprises depositing a carbon-based layer on the surface of the substrate;

the method further comprising depositing at least one bonding layer between the surface of the substrate and the carbon-based layer.

* * * * *